US005203145A

United States Patent [19]

Kammler et al.

[11] Patent Number: 5,203,145

[45] Date of Patent: Apr. 20, 1993

[54] STRIPPER MECHANISM FOR A TUBULAR BAG PACKAGING MACHINE

[75] Inventors: Roman Kammler, Worms; Dirk Wenzel, Simtshausen; Werner Schneider, Hohenahr-Erda, all of Fed. Rep. of Germany

[73] Assignee: Rovema Verpackungsmaschinen GmbH, Fernwald-Annerod, Fed. Rep. of Germany

[21] Appl. No.: 803,280

[22] Filed: Dec. 4, 1991

[30] Foreign Application Priority Data

Dec. 5, 1990 [DE] Fed. Rep. of Germany ... 9016520[U]

[51] Int. Cl.[5] ..... B65B 51/30; B65B 9/20

[52] U.S. Cl. ..... 53/552; 53/554

[58] Field of Search ..... 53/451, 551, 552, 554, 53/373.2

[56] References Cited

U.S. PATENT DOCUMENTS

| | | | |
|---|---|---|---|
| 2,915,866 | 12/1959 | Bartlo | 53/552 X |
| 2,956,383 | 10/1960 | Gausman | 53/552 X |
| 2,960,808 | 11/1960 | Pike | 53/551 X |
| 3,256,673 | 6/1966 | Tew et al. | 53/551 |
| 3,629,987 | 12/1971 | Klopfenstein et al. | 53/182 |
| 4,532,753 | 8/1985 | Kovacs | 53/552 X |
| 4,750,313 | 6/1988 | Kammler et al. | 53/451 |
| 4,768,327 | 9/1988 | Mosher | 53/451 |
| 5,062,253 | 11/1991 | Bacon et al. | 53/551 X |

FOREIGN PATENT DOCUMENTS

| | | |
|---|---|---|
| 0182505 | 5/1986 | European Pat. Off. . |
| 0276628 | 8/1988 | European Pat. Off. . |
| 0291092 | 11/1988 | European Pat. Off. . |
| 4005077 | 8/1991 | Fed. Rep. of Germany . |
| 1456882 | 12/1976 | United Kingdom . |

*Primary Examiner*—Horace M. Culver

*Attorney, Agent, or Firm*—Flynn, Thiel, Boutell & Tanis

[57] ABSTRACT

The invention relates to a stripper mechanism for a tubular bag packaging machine, in which a foil strip (1) is formed into a tube (3) by means of a longitudinal sealing jaw (2) and is formed into bags by means of cross-sealing jaws (4). A stripper mechanism (5) is arranged in the area of the cross-sealing jaws (4), which stripper mechanism (5) includes two stripper rods (6) supported on the end areas of support arms (7). In order to provide a drive for the stripper mechanism (5), which drive is independent of the drive of the cross-sealing jaws (4), the stripper rods (6) are connected to a common closing mechanism (8), and that furthermore the stripper rods are connected to a moving mechanism (9) for effecting a relative movement along the foil tube (3).

25 Claims, 16 Drawing Sheets

STRIPPER MECHANISM FOR A TUBULAR BAG PACKAGING MACHINE

FIELD OF THE INVENTION

The invention relates to a stripper mechanism for a tubular bag packaging machine in which a foil strip is formed into a tube by means of a longitudinal seam sealing jaw and, after filling, is formed into bags by means of cross-sealing jaws, with a stripper mechanism being arranged in the area of the cross-sealing jaws, which stripper mechanism includes at least two opposing stripper rods arranged on opposite a pair in which sides of the tube is moved, which stripper rods are movable along and against the tube each stripper rod being mounted on an end area of a pivotal support arm for facilitating a separating movement and closing movement of the stripper rods.

BACKGROUND OF THE INVENTION

A mechanism of the described type is known from U.S. Pat. No. 4 663 917. Furthermore, DE-OS 37 32 033 shows a similar sealing mechanism.

The stripper rods are, in the known mechanisms, connected to a drive mechanism which at the same time is used to move the cross-sealing jaws. Thus, it is practically not possible to move the stripper rods independently of the cross-sealing jaws. From this results the disadvantage that the cross-welding system having the cross-sealing jaws must also have the stripper rods. It is not possible with this drive-like coupling to provide any type of sequential movement for the stripper rods and the cross-sealing jaws. This is particularly annoying with respect to the movement of the cross-sealing jaws and the stripper rods in longitudinal direction of the foil tube. The crosssealing jaws must be moved together with the foil tube during the duration of the sealing without a relative movement occurring between the sealing jaws and the tube. Compared to this, it is unavoidable in the case of the stripper rods to provide a relative movement between the foil tube and the rods in order to compress the material in the tube which is to be packaged downwardly into the bag, and to free the welding area of the foil tube from the material to be packaged.

A further disadvantage of the so far known constructions is that, in particular, the design of the drive of the cross-sealing jaws cannot be changed independently from the stripper mechanism so that, as this is shown in U.S. Pat. No. 4 663 917, the cross-sealing jaws must be pivoted together with the stripper mechanism. A rotating design of the cross-sealing jaws is thereby not possible. Here problems arise regarding the masses to be moved and the occurring vibrations. A similar situation is true for the mechanism known from DE-OS 37 32 033, in which both the cross-welding jaws and also the stripper mechanism must be moved in the circular curved track. Problems result during rotation of these mechanisms with respect to acceleration and deceleration, which problems are also enhanced by the relatively large rotating masses.

The invention relates furthermore to a stripper mechanism for a tubular bag packaging machine comprising two stripper tools arranged on both sides of the path of movement of the tubular bag, which stripper tools can be moved by means of a drive mechanism.

In a tubular bag packaging machine, a foil strip is guided over a forming shoulder and is formed into a tube by means of a longitudinal seam sealing mechanism, which tube encloses a fill pipe or a format pipe through which the product to be packaged can be guided into the interior of the foil tube. The individual bags containing the product are each closed off by means of a bottom and a top seam, creating thereby in each case simultaneously the top seam of the preceding bag and the bottom seal of the next following bag. A mechanism of this type is known for example from U.S. Pat. No. 4 663 917.

U.S. Pat. No. 4 391 081 shows a stripper mechanism for a tubular bag packaging machine in which the movement of the stripper tools and of the cross-welding jaws is coupled with one another. The cross-welding jaws are movable through a four-bar mechanism or scissors mechanism, with the up and down movement of the stripper tools being caused by the opening and closing movement of the cross-welding jaws. This development of the invention does not make it possible to adjust and optimize the stripping operation with respect to the sealing operation because of the rigid coupling of the up and down movement of the stripper tools.

It is necessary during the construction of the top seam and of the bottom seam by means of a pair of cross-sealing jaws to keep the sealing area of the foil tube free of residues of the material to be packaged. In particular in the case of bulky material, as for example potato chips, there exists the risk that after the bag is closed off by the bottom seam and filled, the bag still being open at the top, the product does not evenly fall into the bag. Stripper tools are used for this reason, which, usually in the form of a pair of beams, are moved downwardly along the bag in order to transport the product completely into the bag and out of the area of the bottom and top seam.

Caused by the technical sequence of such a tubular bag packaging machine, in which the foil tube moves essentially continuously through the machine, it is necessary that the stripper mechanism be designed so that in its sequence of movement the stripper tools, in addition to the speed of movement of the foil tube, can carry out a stripping movement. Furthermore, it is necessary because of this type of a system to carry out the stripping operation in the closing area of the cross-sealing jaws. The stripper mechanism must thus be moved into the open space formed between the crosssealing jaws and the foil tube with the cross-sealing jaws being open. The stripper tools are thereafter closed and are thus placed against the foil tube and are thereafter moved downwardly. This assures that during the use of the stripper mechanism the cross-sealing jaws must remain open. The available station time thus limits the cross-sealing time and the time during which the stripper mechanism is in operation.

The basic purpose of the invention is to provide a stripper mechanism of the described type, which has a drive which is independent of the cross-sealing jaws, and which with a simple design and reliable applicability can be utilized in any desired types of tubular bag packaging machines.

The invention has the further purpose of providing a stripper mechanism of the mentioned type which, with a simple design and reliable applicability, enables an adjustment of the speed of movement of the stripper mechanism so that the time for the stripping operation and the sealing operation can be maximized.

SUMMARY OF THE INVENTION

This purpose is attained according to the invention by the stripper rods being connected to a common closing mechanism and by the stripper rods being connected to a moving mechanism which facilitates a relative movement along the foil tube.

The stripper mechanism of the invention is distinguished by a number of significant advantages. Since according to the invention the stripper mechanism is designed such that the stripper rods are connected to a common closing mechanism, the closing movement can occur independently of a movement of the cross-welding jaws or other structural elements. It is thus possible to carry out an opening and closing of the stripper rods independently from other operations of movement and to optimize such opening and closing depending on the respective frame conditions. It is furthermore particularly advantageous, according to the invention, that the stripper rods are connected to a separate moving mechanism which facilitates a relative movement along the foil tube, namely a stripping movement. The stripper mechanism of the invention thus makes it possible to individually control the two movements of the stripper rods and to enable an adjustment of these movements in an optimal manner to the respective applicable conditions. Furthermore, the stripper mechanism of the invention is with respect to its drive independent of the cross-sealing jaws so that the mechanism can be utilized both in tubular bagging machines with rotating and also with conventional back and forth moving cross-welding jaws.

Since the stripper rods can be moved longitudinally of the foil tube relative to same, the stripping paths can be adapted to the respective applicable conditions. It is in particular possible to provide longer stripping paths. In addition, there results a possibility of varying and adjusting the stripping paths in a particularly simple manner.

It is furthermore advantageous that no additional dynamic stress of the drive of the cross-welding jaws occurs since the strippers do not rotate with the cross-welding jaws as this was necessary up to now in rotating tubular bagging machines.

A particularly favorable development of the invention provides that the support arms are constructed like a scissors linkage having a common swivel axis. In particular, the movement of the stripper rods along the foil tube can be easily carried out in this development since only the bearing area of the swivel axis must be moved in order to carry out the stripping movement of the stripper rods. To use a scissors linkage has the further advantage that an even movement of the support arms is possible and with the closing mechanism having thereby a particularly simple design.

It is furthermore particularly advantageous when the support arms rest on one another in the center area and are connected to the closing mechanism at their free ends. It is thus possible to arrange the closing mechanism outside of the stripping area so that the entire mechanism can be optimized with respect to the structural size and can be adapted to the respective conditions of use. Thus, it is possible to use the stripper mechanism of the invention in particularly small spaces.

The design of the closing mechanism can be varied in a wide range according to the invention, the closing mechanism can, for example, include a piston-cylinder unit so that a drive through compressed air is possible. The closing mechanism can also include plates laterally engaging the supports, which plates are, for example, mechanically controlled through cam plates or the like.

It is particularly advantageous when the closing mechanism includes elastic elements, with the help of which the stripper rods are initially tensioned into the opening position. The closing mechanism is thereby only needed to place the stripper rods against the bag material while the stripper rods open automatically.

A further particularly advantageous development of the invention provides that the support arms together with the closing mechanism are movable along the axis of the foil tube by means of a moving mechanism. The closing mechanism can thus be operated independently of the respective position of the support arms relative to the foil tube. It is particularly advantageous, according to the invention, to carry out both movements, namely the closing movement and the movement along the foil tube independently of one another and/or to couple both drivingly with one another.

The moving mechanism can be designed in various ways. It is, for example, possible to provide it with a crank drive or to use a piston-cylinder arrangement operated, for example, by compressed air. Furthermore, it is possible to use cam-plate elements to move the support arms and the stripper rods.

In order to be able to adapt particularly well the movement of the stripper rods during the stripping operation relative to the foil tube to the respective requirements, it is advantageous when the moving mechanism has a first mechanism for causing a lifting movement and a second mechanism for causing a downwardly directed stripping movement. This in particular opens up the possibility of carrying out the two movements at different speeds and/or to use different drive means. Thus, for example, both the first and also the second mechanism can include a piston-cylinder arrangement.

The stripper mechanism of the invention is distinguished in a further development by a number of further advantages. Since according to the invention the stripper tools are supported on a carriage which can be moved by means of the crank drive, it is possible to move the stripper tools in a direct association with the movement of the cross-welding jaws into the space between the opened cross-welding jaws or to remove these from such space. Thus, it is avoided, on the one hand, that the stripper tools collide with the cross-welding jaws, on the other hand no additional control and/or drive means need to be provided in order to operate the stripper mechanism itself. Furthermore, a very important advantage of the invention results from the crank drive including means for changing the crank lift. From this follows that the crank lift does not remain constant in the usual manner during one rotation, that is, during one operating cycle. This opens up the possibility of longitudinally moving the carriage at different speeds. The stripper mechanism can thus be introduced at a relatively high speed upwardly into the free space between the opened cross-sealing jaws, while the downwardly directed stripping stroke can occur at a slower speed. The time intervals of one cycle which can be used neither for the cross-sealing operation nor for the stripping operation can thus be minimized.

It is particularly advantageous when the drive of the cross-welding jaws and the drive mechanism of the stripper tools are coupled in a phase-shifted manner with one another to a common drive. This makes it possible to operate both structural element groups by means of one common drive. This results in a considerable simplification of the tubular bag packaging machine. The phase-shifted coupling causes an exactly adapted and adjusted sequence of movement.

The stripper tools are advantageously operable by a cam-driving mechanism which includes a curved track or a cam plate. An additional drive is thus not needed so that this also results in a significant simplification of the entire design. Thus, only one drive is used in order to drive the sealing jaws and to synchronize the stripper tools.

Furthermore, it can be advantageous when safety plates are provided, which safety plates can be of a cam-like form in order to cause the stripper rods to close on time when the closing impulse is not released on time or fails completely. This is of particular importance when the air supply for the closing cylinder does not operate according to plan.

Furthermore, it can be advantageous when a safety circuit is provided for controlling the drive mechanism of the stripper tools and the drive of the cross-welding jaws. This safety circuit includes preferably a sensor which checks the opening or closing operation of the stripper tools. When the synchronization between the dosaging device and the packaging machine is missing, it can happen that a bag is filled with a product in the sealing area caused by a double fill. The stripper tools hit in this case a tightly filled bag and are not able to compress the product downwardly. The stripper tools thus remain automatically in the opened position. The cross-welding jaws, which then start to operate, would now meet the stripper tools and would destroy the entire mechanism. In order to prevent this, a sensor is used, for example an inductive sensor, which is mounted onto the pneumatic cylinder which operates the stripper tools. The piston of the pneumatic cylinder can, for example, include a magnetic material which will facilitate the producing of a signal in the inductive sensor. The safety circuit in the described case results in a turning off of the jaw and stripper drive when the piston of the pneumatic cylinder has not passed the sensor. The position of the sensor can be chosen at random. Optic monitoring means can also be used.

A further, particularly favorable, development of the invention provides that the crank drive includes a drive rod pivotally supported at its one end on the carriage and at its other end by means of a guide bolt on a rotatable crank, and that the guide bolt is movably supported along the crank. By moving the guide bolt of the drive rod relative to the crank, the effective length of the crank can be varied in a particularly simple manner so that a change of the operating lift and thus a change of the speed of the carriage at a constant rotational speed of the crank result.

In order to make the movement of the guide bolt along the crank easier, it is provided that the guide bolt is guided in a slotted hole in the crank. This construction is particularly advantageous at high speeds of movement and very short cycle times.

In order to guarantee the movement of the guide bolt along the crank in a suitable manner, it is particularly advantageous to support a cam-plate element in the area of the crank, on which element is guided the guide bolt. The cam-plate element can be designed, for example, like a cam plate or a guide cam. Thus, the guide bolt is guided on the curved track during each rotation of crank. It is thereby particularly advantageous when the guide bolt is initially tensioned by means of an initial-tensioning element against the guideway of the cam plate. This results in a particularly simple design of the cam plate. As an alternative, it is also possible to confine and to guide the guide bolt in a circular groove or a similar curved track.

The cam plate is preferably supported in the area of the axis of rotation of the crank, with the support being designed such that the cam plate is not rotatable together with the crank. It is furthermore particularly advantageous when the cam plate is exchangeable. This opens up the possibility of adapting the movement of the stripper tools to different production conditions, for example bag sizes or stripping controls.

It is advantageous in a common development of the stripper mechanism when the cam plate includes a circular area and an ellipsoidal area. The circular area is used to move the carriage very quickly upwardly between the opened cross-welding jaws, while the ellipsoidal area brings about a longer crank length and thus a slower movement of the carriage during the stripping operation.

In order to be able to open or close the stripper tools in the usual manner, it is provided according to the invention that the drive mechanism for effecting an operation of the stripper tools is in the form of a pneumatic cylinder supported on the carriage. This drive is, on the one hand, designed to have a relatively low weight and, on the other hand, the air can be supplied in a very simple manner through flexible hoses.

BRIEF DESCRIPTION OF THE DRAWINGS

The invention will be described hereinafter using exemplary embodiments in connection with the drawings, in which.

DESCRIPTION OF PREFERRED EXEMPLARY EMBODIMENTS

Figure 1:
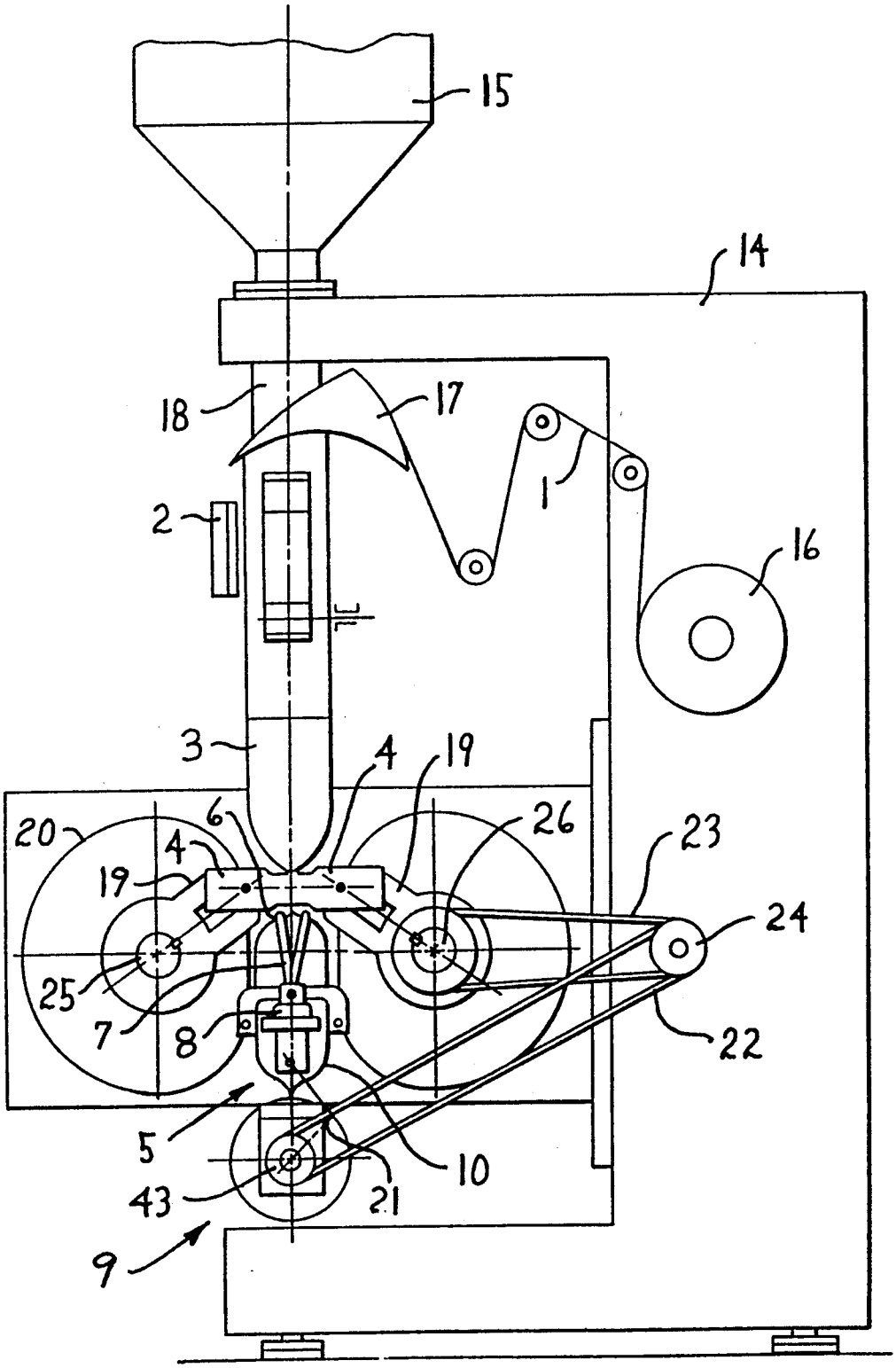
FIG. 1 is a schematic side view of a tubular bag machine embodiment of the invention.

The tubular-bag machine illustrated in FIG. 1 has a frame 14 which is essentially C-shaped in the side view thereof. A dosaging funnel 15 is arranged at the upper area of the frame 14 and contains the material to be packaged. A storage roll 16 of a foil strip 1 is rotatably supported on the frame 14. The foil strip 1 is guided over a forming shoulder 17 and is shaped into a tube 3 by means of at least one longitudinal sealing jaw 2. The tube 3 surrounds a fill pipe 18, through which fill pipe the material to be packaged is filled into the interior of the tube 3. Below the longitudinal sealing jaw 2 there are two oppositely lying cross-sealing jaws 4 which are movable in a suitable manner in order to form the bottom and the top area of bags 10. The cross-sealing jaws 4, in the illustrated exemplary embodiment, are rotatably supported on arms 19. The rotating cross-sealing jaws 4 are guided on an essentially D-shaped guideway 20 so that the cross-sealing jaws 4 are guided parallel to the tube 3 in the area of their welding operation.

A stripper mechanism 5 is supported below the cross-sealing jaws 4, which stripper mechanism 5 includes two parallel stripper rods 6 which can be laterally moved against the tube 3. The stripper rods 6 are supported on pivotal support arms 7.

The stripper mechanism 5 includes a closing mechanism 8 and a moving mechanism 9. The closing mechanism 8 is used to urge the stripper rods 6 against the bag material or to release them from said bag material, while the moving mechanism 9 is used to move the stripper rods 6 in longitudinal direction of the tube 3.

FIG. 1 illustrates schematically how the cross-sealing jaws 4 and the closing and moving mechanism 8, 9 can be driven. The moving mechanism 9 is equipped with a crank assembly 21 connected to a drive shaft 24 through a drive element 22. The drive shaft 24 drives the arms 19 of the cross-sealing jaws 4 through a drive element 23.

The operation of the tubular-bag machine is known from the state of the art so that a more detailed description is not needed.

Figure 2:
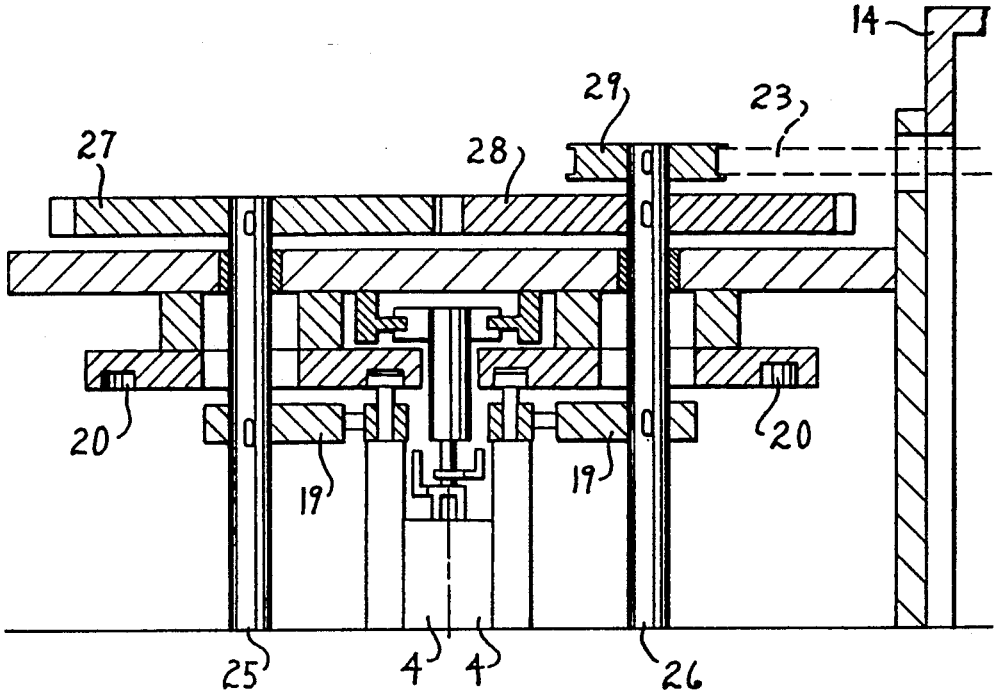
FIG. 2 is a detailed top view of the drive mechanism for the axles of the sealing jaws of an exemplary embodiment of the stripper system of the invention.

FIG. 2 illustrates in a top view the drive mechanism for the axles of the sealing jaws and drive mechanism for the stripper system. The two axles 25, 26 of the sealing jaws are connected at their ends through gears 27 and 28 which mate with one another and assure a synchronous movement of the sealing jaws 4. The sealing-jaw axle 26 has furthermore a gear 29 thereon connected to the drive element 23, for example a chain, in order to make it possible in this manner that the cross-sealing jaws are driven.

The arms 19 extend laterally from the sealing-jaw axles 25, 26 and, in turn, carry the cross-sealing jaws 4. FIG. 2 shows furthermore the guideway 20 in which the cross-sealing jaws are guided.

Figure 3:
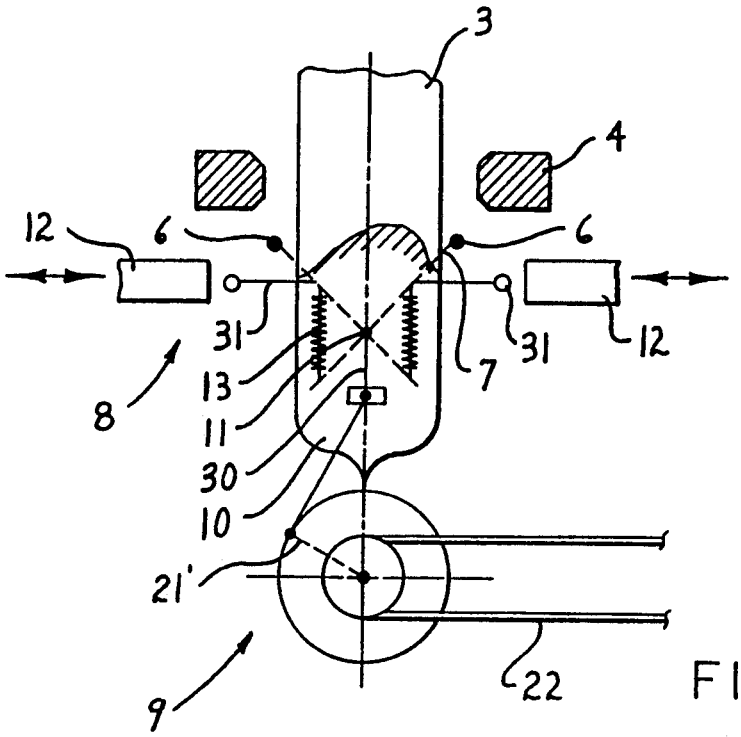
FIG. 3 is a schematic side view of an exemplary embodiment of the stripper mechanism of the invention.
Figure 4:
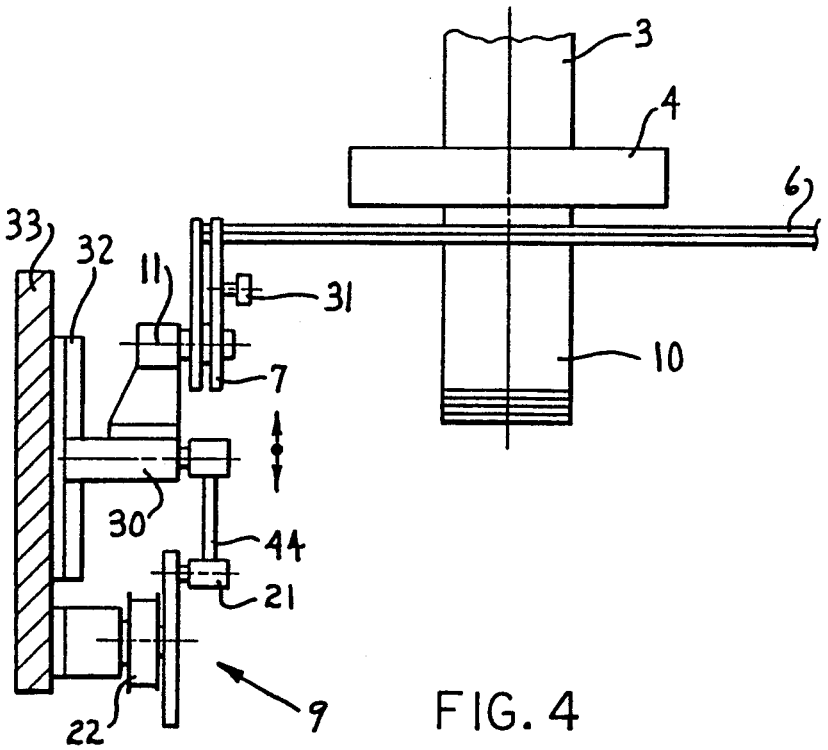
FIG. 4 is a side view of the arrangement shown in FIG. 3.

FIGS. 3 and 4 show schematic side views of an exemplary embodiment of the stripper mechanism of the invention. The support arms 7 are in this exemplary embodiment connected with one another at a common swivel axle 11 so that, as a whole, a scissors mechanism is formed. Elastic elements 13 engage furthermore the support arms 7 in order to initially urge the stripper rods 6 into an open position between which the tube 3 can be guided. The swivel axle 11 is supported on a carriage 30 which can be moved up and down by a crank assembly 21 in order to be able to carry out the stripping operation. Laterally spaced and movable plates 12 are provided for closing of the stripper rods 6, which plates, as is indicated by the arrows, can be moved laterally back and forth. These plates are operatively connected to rams 31 on the support arms in order to operate the support arms.

FIG. 4 shows an enlarged detailed view of the arrangement shown in FIG. 3, from which results the association of the structural elements illustrated in FIG. 3. FIG. 4 shows in particular how the carriage 30 is supported on a guide rail 32. The guide rail 32 is supported on a jaw-pole sidewall 33. Thus the carriage 30 is moved up and down along the guide rail 32 by the crank assembly 21 in order to cause in this manner the stripping movement of the stripper rods 6. The up and down movement of the carriage 30 thus results also in an up and down movement of the swivel axle 11 for the support arms 7. The support arms are laterally pivoted by the rams 31 in order to open and close the stripper rods.

Figure 5:
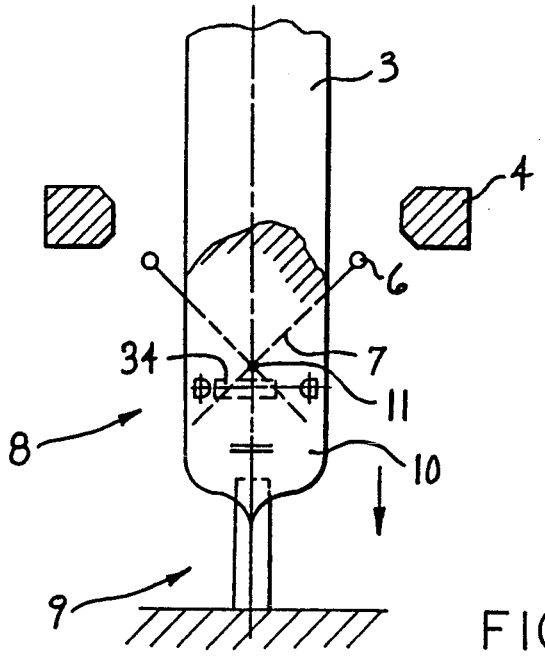
FIG. 5 is a side view of a further exemplary embodiment of a stripper mechanism.
Figure 6:
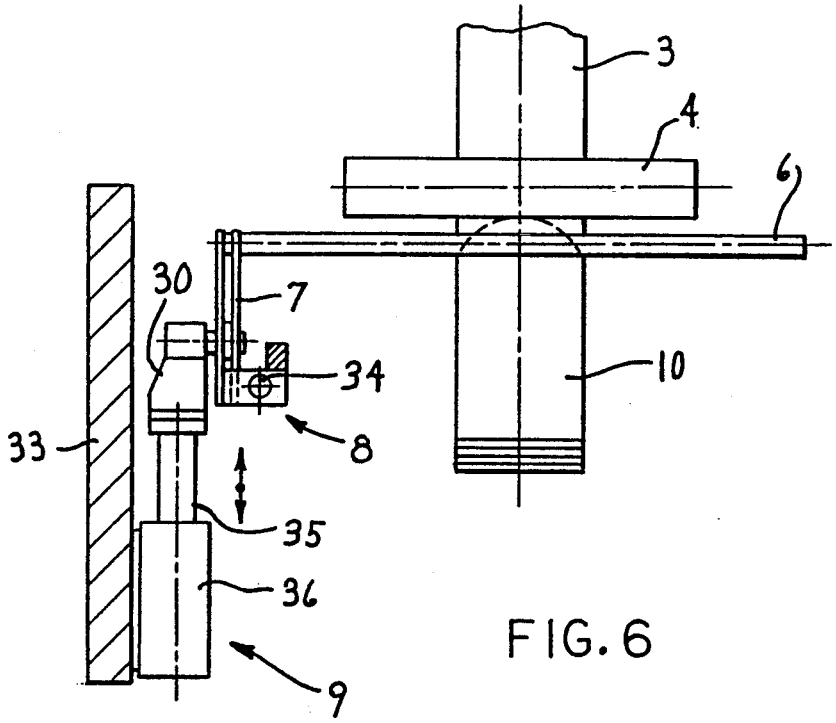
FIG. 6 is a side view of the arrangement shown in FIG. 5.

FIG. 5 shows a further exemplary embodiment of the stripper mechanism of the invention, the same structural elements being identified by the same reference numerals. FIG. 6 shows, similar to FIG. 4, a side view. The exemplary embodiment illustrated in FIGS. 5 and 6 differs from the exemplary embodiment of FIGS. 3 and 4 in that the closing mechanism 8 has a pistoncylinder arrangement, namely a compressed-air cylinder 34, with which the free end areas of the support arms 7 are operatively connected. FIG. 6 shows that the carriage 30 is fastened to a piston rod 35 operable by a compressed-air cylinder 36. Thus, the moving mechanism 9 includes the compressed-air cylinder 36 and the piston rod 35, while the closing mechanism 8 is formed by the compressed-air cylinder 34. The compressed-air cylinder 36 thus carries out both a lifting movement to lift the stripper rods 6 and also a downwardly directed stripping movement.

Figure 7:
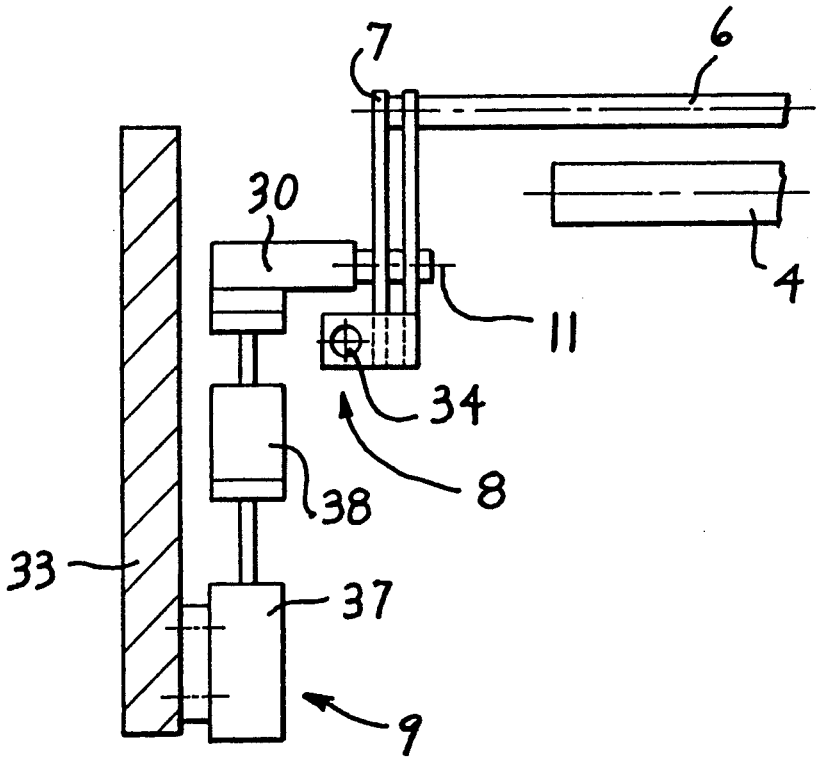
FIG. 7 is a partial side view of a further exemplary embodiment, similar to FIGS. 4 and 6.

FIG. 7 illustrates a further exemplary embodiment in a view similar to FIGS. 4 and 6. This exemplary embodiment differs from the exemplary embodiment illustrated in FIG. 6 in that the moving mechanism 9 has two compressed-air cylinders 37 and 38. The compressed-air cylinder 37 is used to carry out a lifting movement of the carriage 30 and thus of the stripper rods 6, while the compressed-air cylinder 38 carries out a stripping movement along the length of the foil tube 3. The stripper rods 6 are opened and closed by the compressed-air cylinder.

Figure 8:
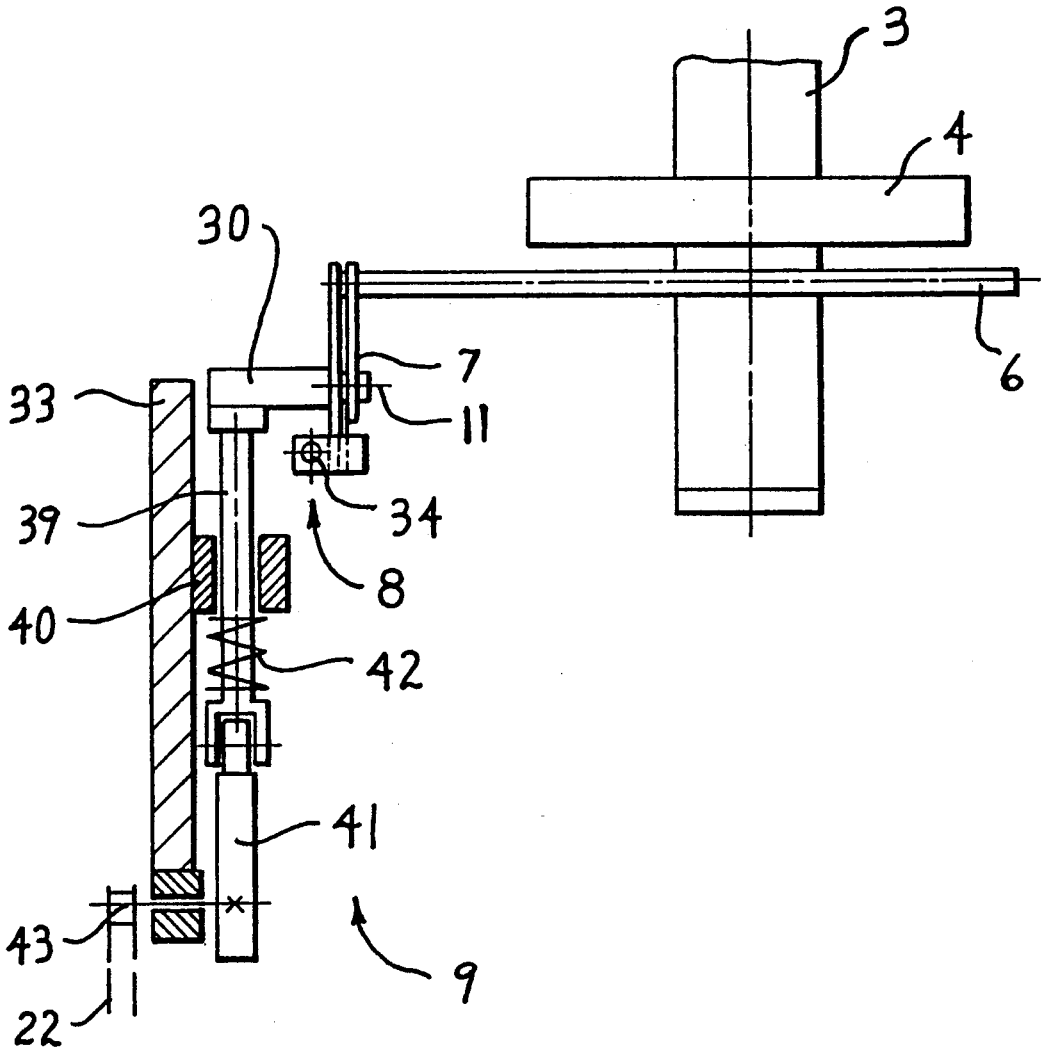
FIG. 8 is a partial side view of a further exemplary embodiment, similar to FIG. 7.

FIG. 8 shows a further exemplary embodiment which differs from the exemplary embodiments of FIGS. 4, 6 and 7 in that the carriage 30 is fastened to a ram 39 which is longitudinally guided in bearings 40, which bearings are, in turn, fastened to a sidewall 33. The lower end of the ram 39 is operatively rides on a cam plate 41 rotatably driven by the drive 22. The cam plate 41 causes both the lifting and also the stripping movement. The ram 39 is initially urged against cam plate 41 by means of a spring 42.

Figure 9:
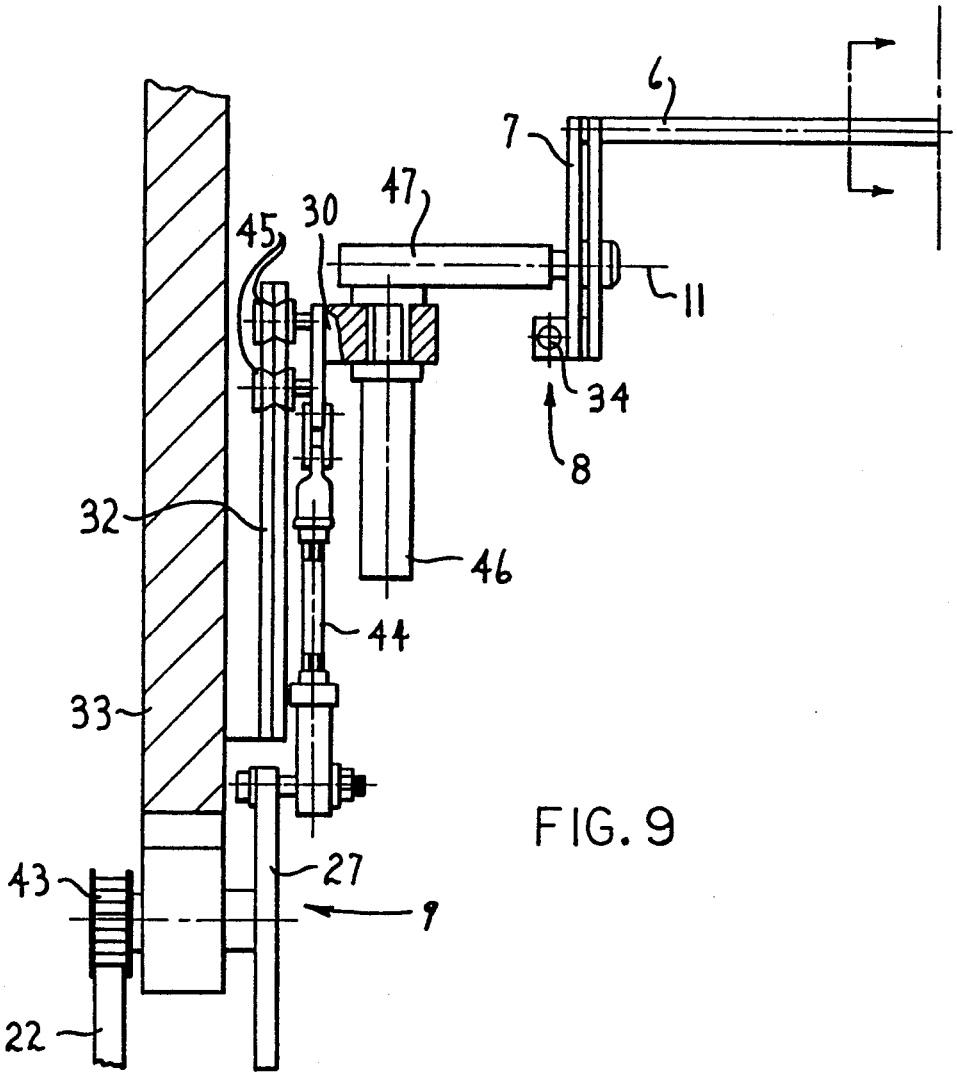
FIG. 9 is a partial side view of a further exemplary embodiment of the drive mechanism of the invention, similar to FIG. 8.
Figure 10:
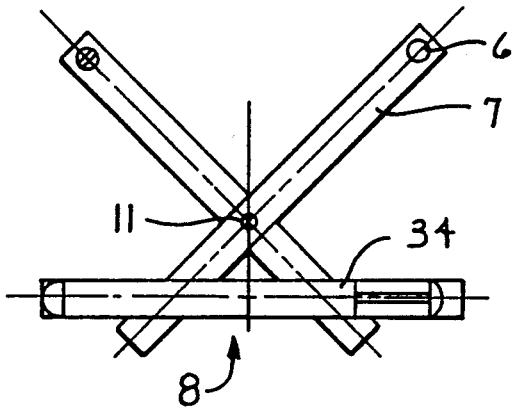
FIG. 10 is a schematic detailed view of an exemplary embodiment of the support arms and the closing mechanism.

FIGS. 9 and 10 show a further exemplary embodiment. The same parts are here again also identified by the same reference numerals so that a detailed description is not needed. Similar to the exemplary embodiment illustrated in FIG. 4, a crank disk 21 is driven by the drive element 22 mating with a gear 43. A connecting rod 44 is pivotally supported on the crank disk, which connecting rod 44 in turn is pivotally connected to the carriage 30. The carriage 30 is, as shown in FIG. 4, movably supported on a guide rail 32. The guide rail has a double-V-shaped cross section so that guide wheels 45 which are supported on the carriage 30 can grip the guide rail 32 on both sides so as to be safely guided on same. The stripper rods 6 are also, in this exemplary embodiment, opened and closed by the compressed-air cylinder 34, which is again in detail illustrated in the side view of FIG. 10. The compressed-air cylinder 34 is hinged to the free end of one of the support arms 7, while the piston rod, as shown in FIG. 10, is hinged to the free end of the other support arm.

The crank disk 21 is used to carry out the lifting movement of the stripper rod 6. A further compressed-air cylinder 46 is supported on the carriage 30. The piston rod of the compressed-air cylinder 46 is connected to a support 47 on which is provided the swivel axle 11. The compressed-air cylinder 46 carries out the stripping movement.

The stripper rod 6 is formed such that it is rounded at the contact area thereof with the tube material in order to avoid damage to the tube material.

Figure 11:
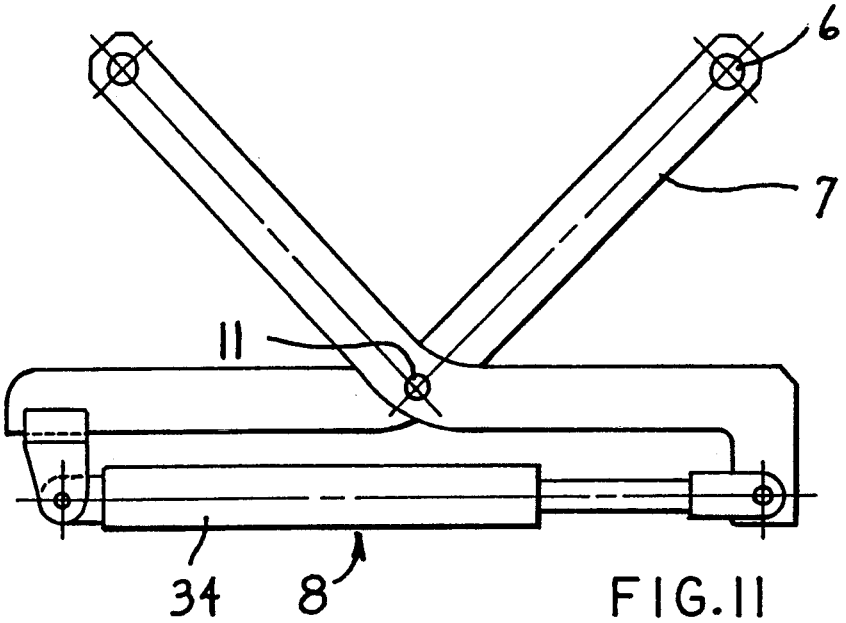
FIGS. 11 to 13 are each schematic side views of further exemplary embodiments of the support arms and of the closing mechanism, in a view similar to FIG. 10, FIGS. 14 to 16 are each schematic illustrations of further exemplary embodiments of the support arms and of the closing mechanisms.
Figure 12:
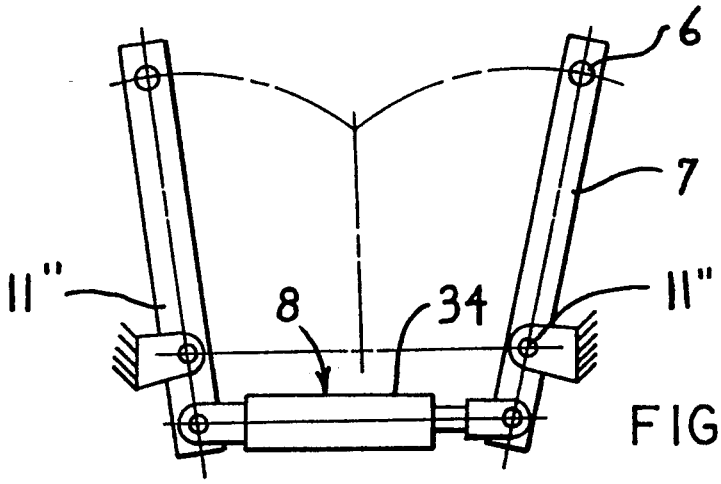
Figure 13:
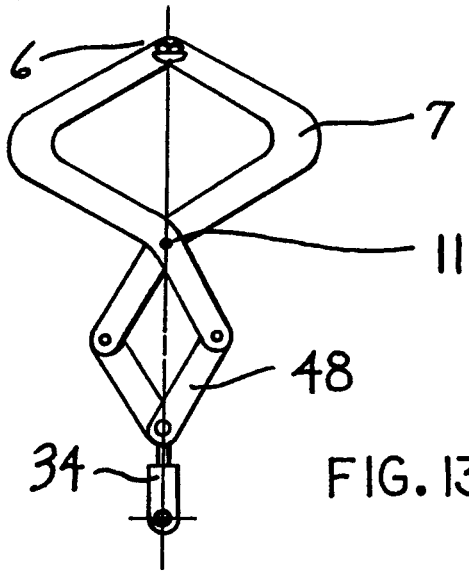

FIGS. 11 to 13 illustrate further embodiments of the support arms 7 and the hinge connection of the compressed-air cylinder 34. In the exemplary embodiment illustrated in FIG. 11, there is provided a scissors mechanism, while in the exemplary embodiment illustrated in FIG. 12, the swivel axles 11' and 11'' of the support arms 7 are spaced from one another and are supported in a suitable manner on a further support, for example the carriage 30. FIG. 13 shows an exemplary embodiment in which the compressed-air cylinder 34 (closing cylinder) is connected by two guide rods 48 jointedly hinged together and to the lower ends of the support arms 7.

Figure 14:
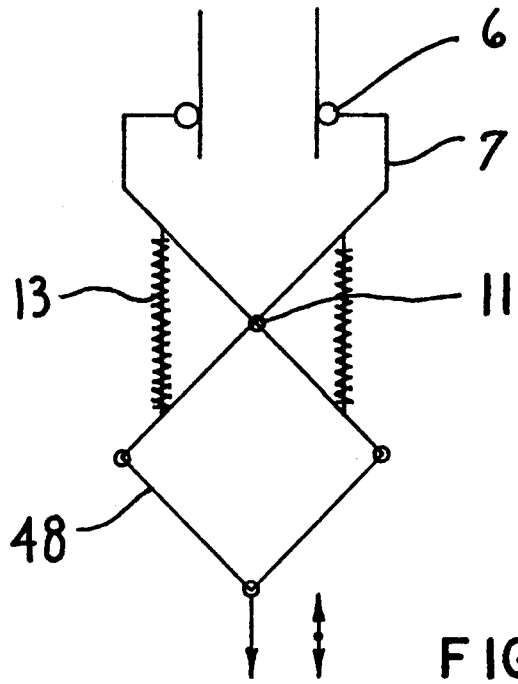
Figure 15:
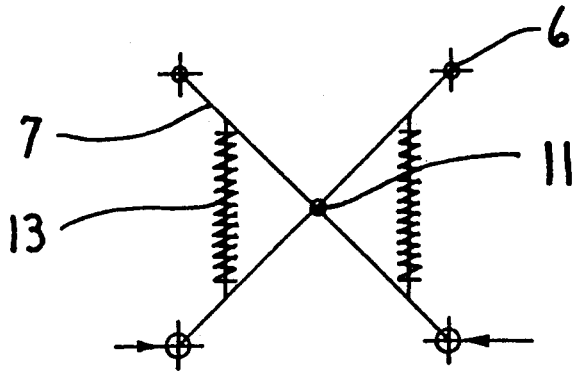
Figure 16:
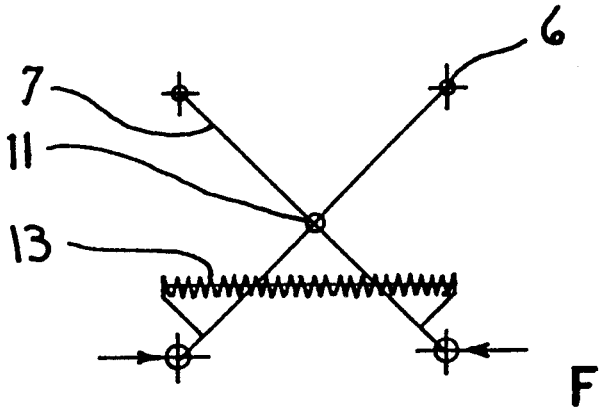

FIGS. 14 to 16 show further theoretical development possibilities for the design of the support arms 7, the same structural parts being here also again identified by the same reference numerals. The illustration of FIG. 14 corresponds with the exemplary embodiment illustrated in FIG. 13; the schematic illustration according to FIG. 15 is analogous to the exemplary embodiment described in FIG. 5; FIG. 16 shows a modification of the exemplary embodiment illustrated in FIG. 15 with only one spring 13 being here provided.

Figure 17:
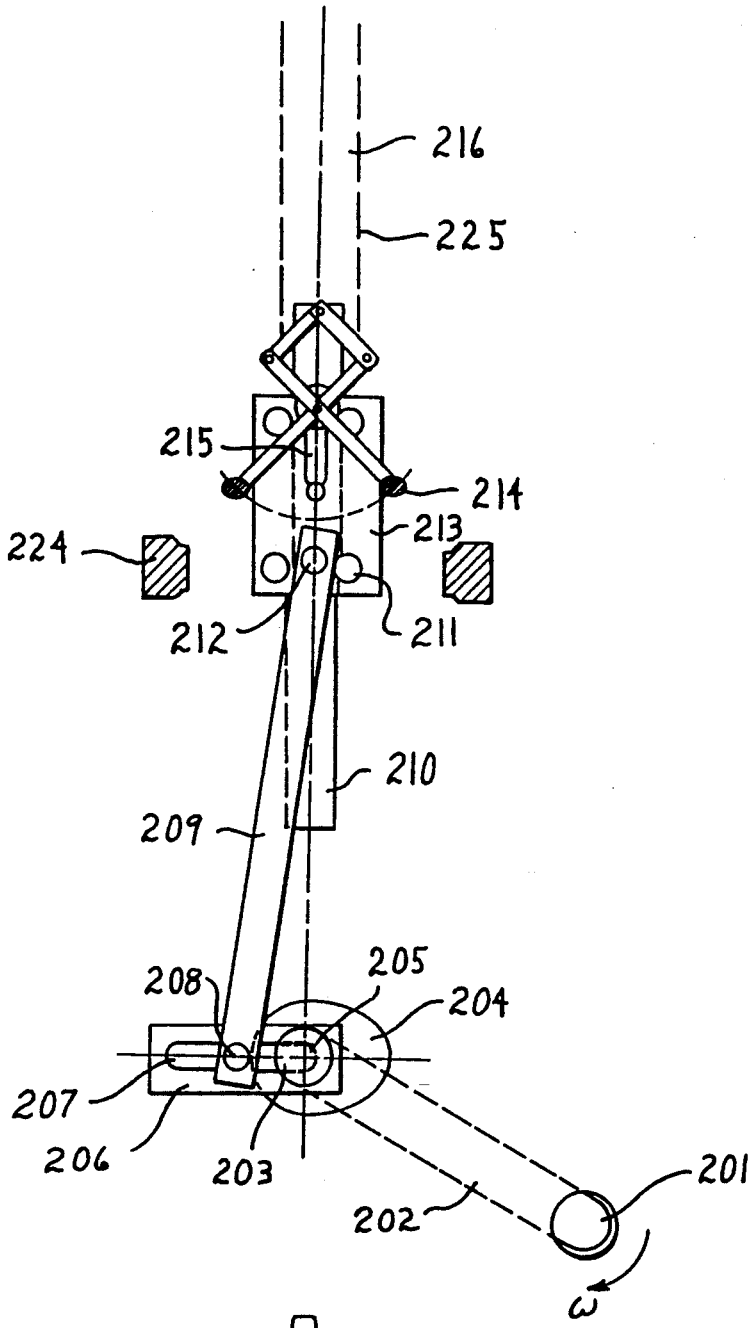
FIG. 17 is a schematic side view of the stripper mechanism of the invention.
Figure 18:
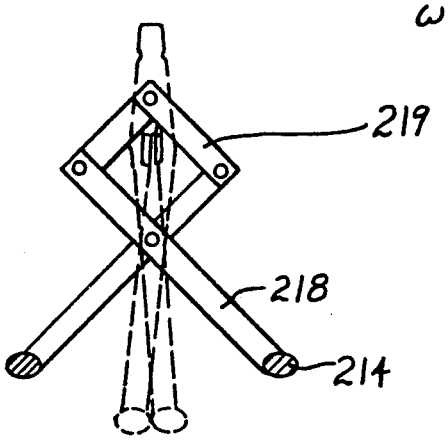
FIG. 18 is an enlarged side view of the stripper tools in an open and a closed position.

The stripper mechanism illustrated in FIGS. 17 to 24 shows a foil tube 225 supplied by a fill pipe or a format pipe 216 prior to a bottom or top seam having been formed by a pair of cross-welding jaws 224. The stripper mechanism has for this purpose two stripper tools 214 which are essentially designed as rod-like elements which extend parallel to one another. The stripper tools 214 are each supported on a lever 218, with the two levers 218 being connected scissors-like at a common joint, as this is illustrated in FIG. 17. Further, levers 219 are hinged to the free ends of the levers 218 so that by changing the distance between the swivel axles of the levers 218 and of the levers 219, the stripper tools 214 are opened and closed. FIG. 18 shows in full lines the stripper tools in an open state, while the dashed lines show the stripper tools in a closed state. The stripper tools are opened and closed by a drive mechanism 215 in the form of a pneumatic cylinder. Same is operated by an air supply 220 only schematically illustrated in FIG. 19.

Figure 19:
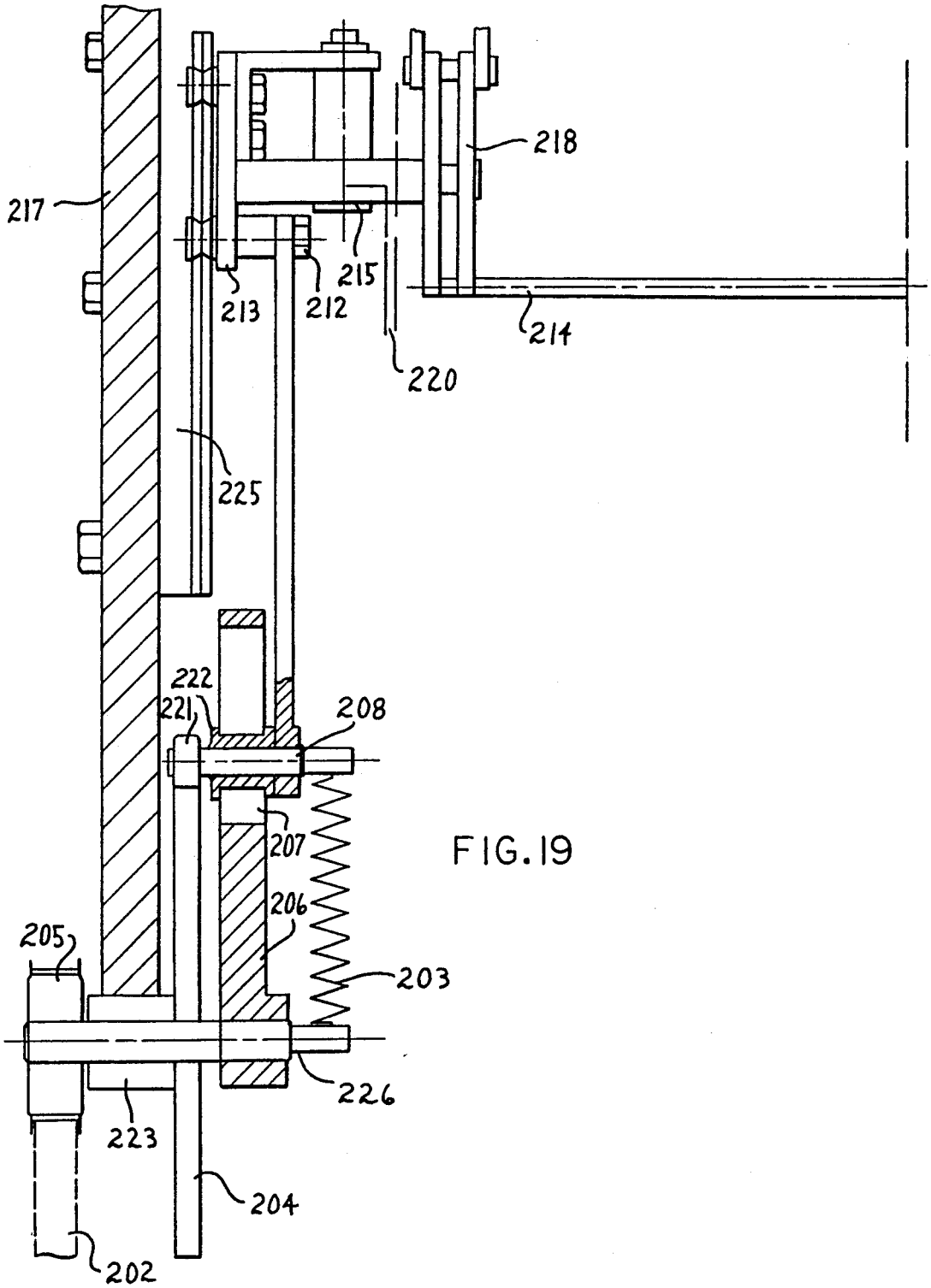
FIG. 19 is a further side view of the left side of the stripper mechanism shown in FIG. 17.

The pneumatic cylinder 215 and the stripper tools 214 and the levers 218, 219 are supported on a carriage 213 movable along a guide rail 210 in longitudinal direction of the foil tube 225. A support 212 is provided at the lower area of the carriage 213. A drive rod 209 is pivotally hinged to the support 212. The end of the drive rod 209 includes, as this can especially be seen in FIG. 19, a guide bolt 208 which is movably guided in a slotted hole 207 of a crank 206. FIG. 19 shows that the guide bolt 208 is guided in the slotted hole 207 by means of a guide sleeve 222. The crank 206 is pivotally supported on a machine frame not illustrated in detail and is fixedly connected to a toothed-belt disk 205 over which is guided a toothed belt 202. Same in turn meshingly engages a toothed-belt disk 201 which is a part of the drive of the cross-sealing tools. Thus, a dependent synchronization of the movement of the carriage 213 and of the stripper tools 214 on the movement of the cross-welding jaws 224 is assured.

A cam roller 221 is supported at the free end of the guide bolt 208, as shown in FIG. 19, and rolls along a cam-plate element 204, which will yet be described in detail. In order to press the guide bolt 206 and thus the cam roller 221 against the outer periphery of the cam-plate element 204, an initial tensioning element (spring) 203 is provided and, which is fastened at one end to the guide bolt 208 and at the other end to the axle of rotation 226 for the crank 206.

The disk-like constructed cam-plate element 204 is mounted not for rotation, however, is exchangeably mounted to a housing 217 of the jaw pole of the cross-sealing jaws, with the fastening of the cam-plate element 204, as this is shown in FIG. 19, taking place in the area of the axle of rotation 226.

FIG. 17 shows the cam-plate element 204 in a side view. This illustration shows that the left half of the cam-plate element 204 is designed essentially circularly, while the right half is ellipsoidal. The circular side of the cam-plate element 204 results in a relatively quick upward movement of the carriage 213, while the ellipsoidal side enlarges the active crank length 206 and thus results in a slower downward movement of the carriage 213 during the stripping operation.

Figure 20:
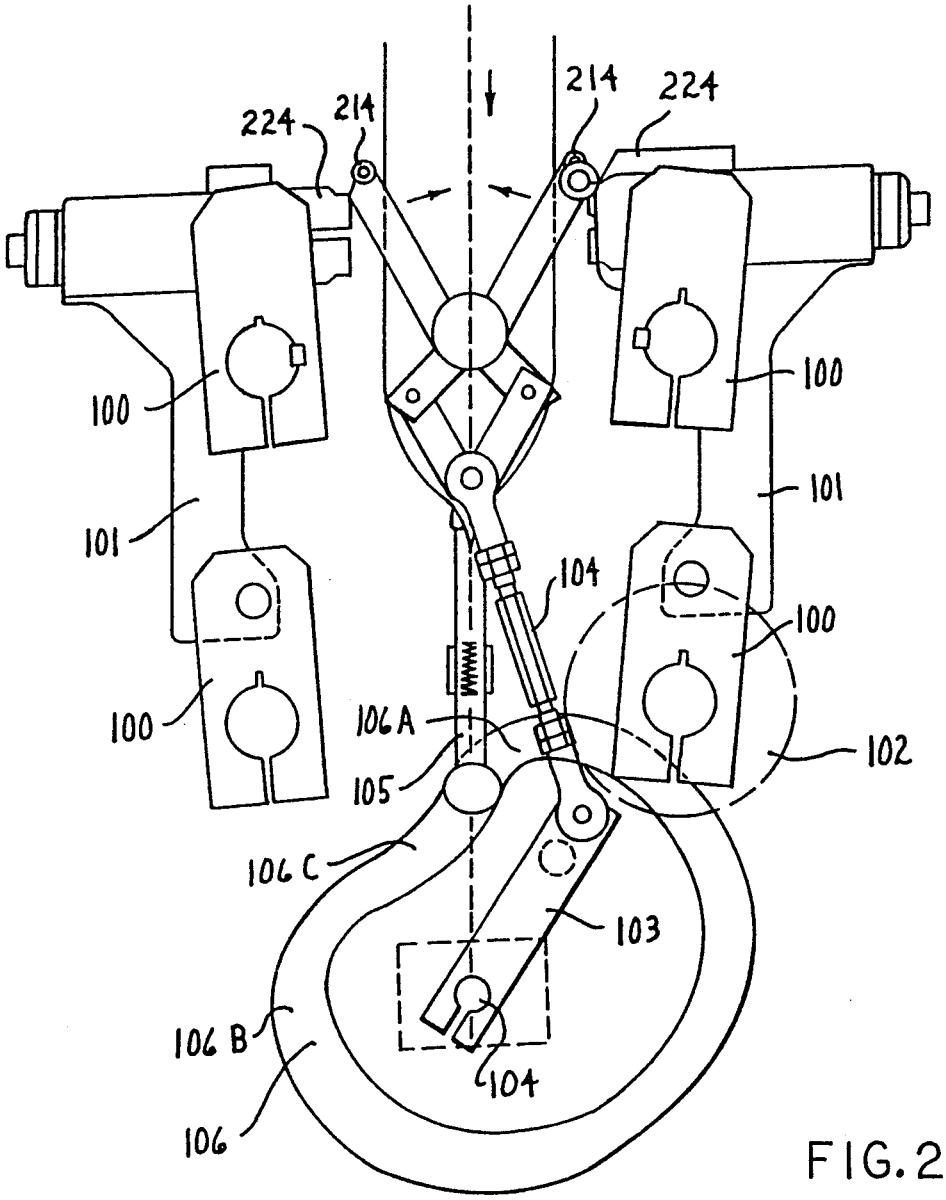
FIG. 20 is a schematic side view of a further exemplary embodiment of the stripper mechanism of the invention, in which the drive for the linear stripper movement is coupled in a phase-shifted manner to the movement of the cross-sealing jaws.

FIG. 20 shows a further exemplary embodiment of the invention in which the drive for the linear movement of the stripper tools occurs in phase shifted manner with respect to the movement of the cross-welding jaws 224. FIG. 20 is very schematic so that only the most important structural elements are shown. The cross-welding jaws are each supported on a lever 100, with two levers 100 each being arranged one above the other so that, together with the axles of rotation for the two levers 100 and a coupling rod 101 each hingedly supported on the levers 100, a four-bar mechanism results. The coupling rod 101 is connected to the cross-welding jaw 224. The latter has, as this is known from the state of the art, in addition heating devices. It is furthermore possible to associate with the crosswelding jaws, preferably in duplicate, a separating device such as a perforator or a knife.

As illustrated by the movement circle 102, the drive shaft (not illustrated in detail) on which the lever 100 is mounted rotates in a pregiven direction. A drive lever 103 starts to rotate coupled with this movement. The drive lever is rotatably supported at reference numeral 104. From the rotating back and forth movement of the lever 100 results also a back and forth swinging movement of the drive lever 103.

The drive lever 103 is connected to a stripper-tool mechanism through a guide rod 104 designed to be longitudinally changeable. The stripper-tool mechanism is designed as shown in FIGS. 17 to 19.

Figure 21:
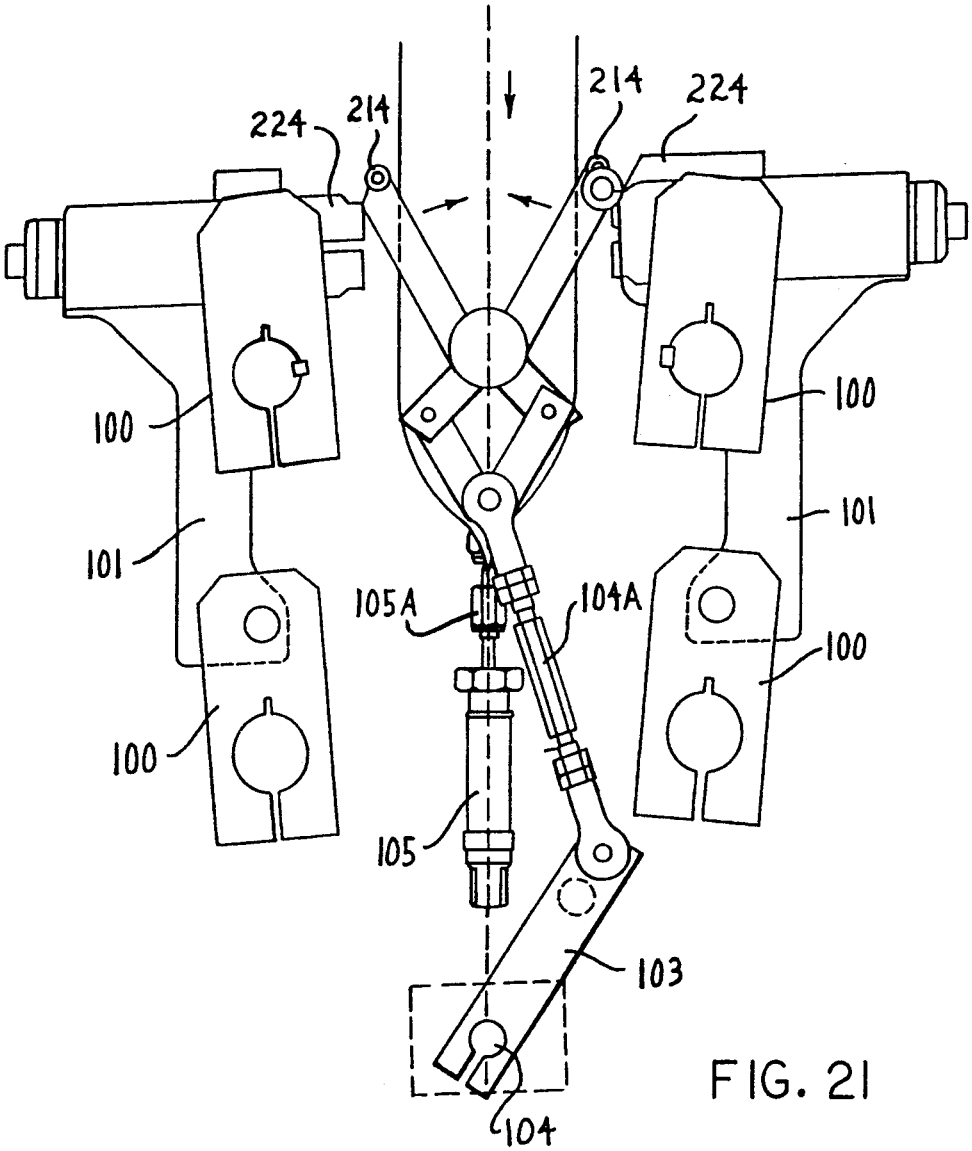
FIGS. 21 to 24 are illustrations of different operating stages during a stripper cycle in a device according to FIG. 20.

A pull rod 105 is additionally provided which is hinged to the stripper-tool mechanism, for example the carriage 213. The lower end of the pull rod 105 runs in a curved track 106. The pull rod 105 is used to close or open the stripper tools 214. The length of both of the guide rod 104 and pull rod 105 can be adjusted, for example, by a turn-buckle like device 104A on the rod (FIG. 21). The curved track 106 has, for example, an area 106A causing the closing operation, while in an area 106B the stripper tools 214 are open. The area 106C of the curved track 106, which area lies on the inside, is an area, in which the stripper tools 214 are closed.

It is also possible to use a cam plate instead of the curved track 106.

An additional drive is not needed when a curved track 106 or a cam plate is used.

Figure 22:
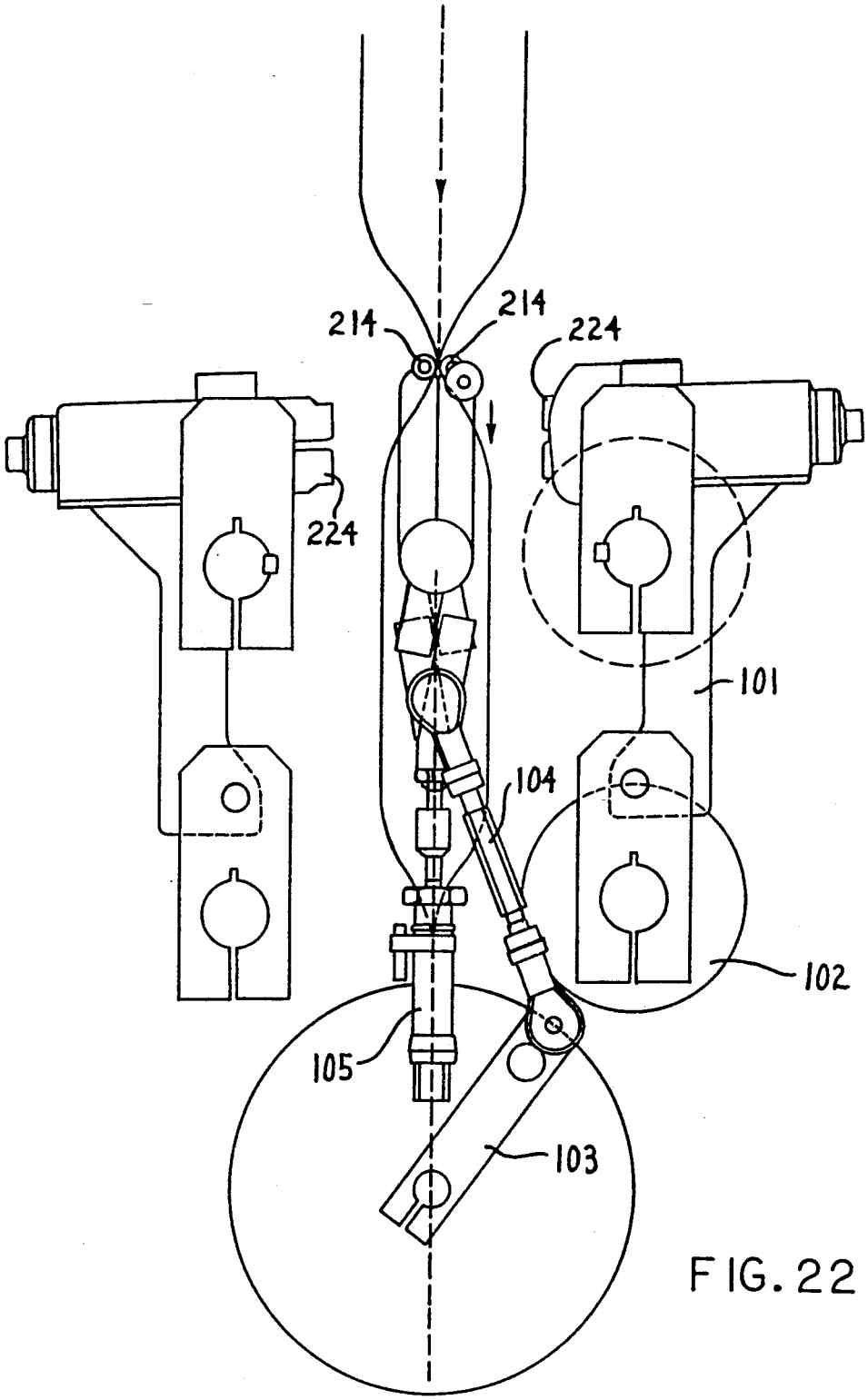
Figure 23:
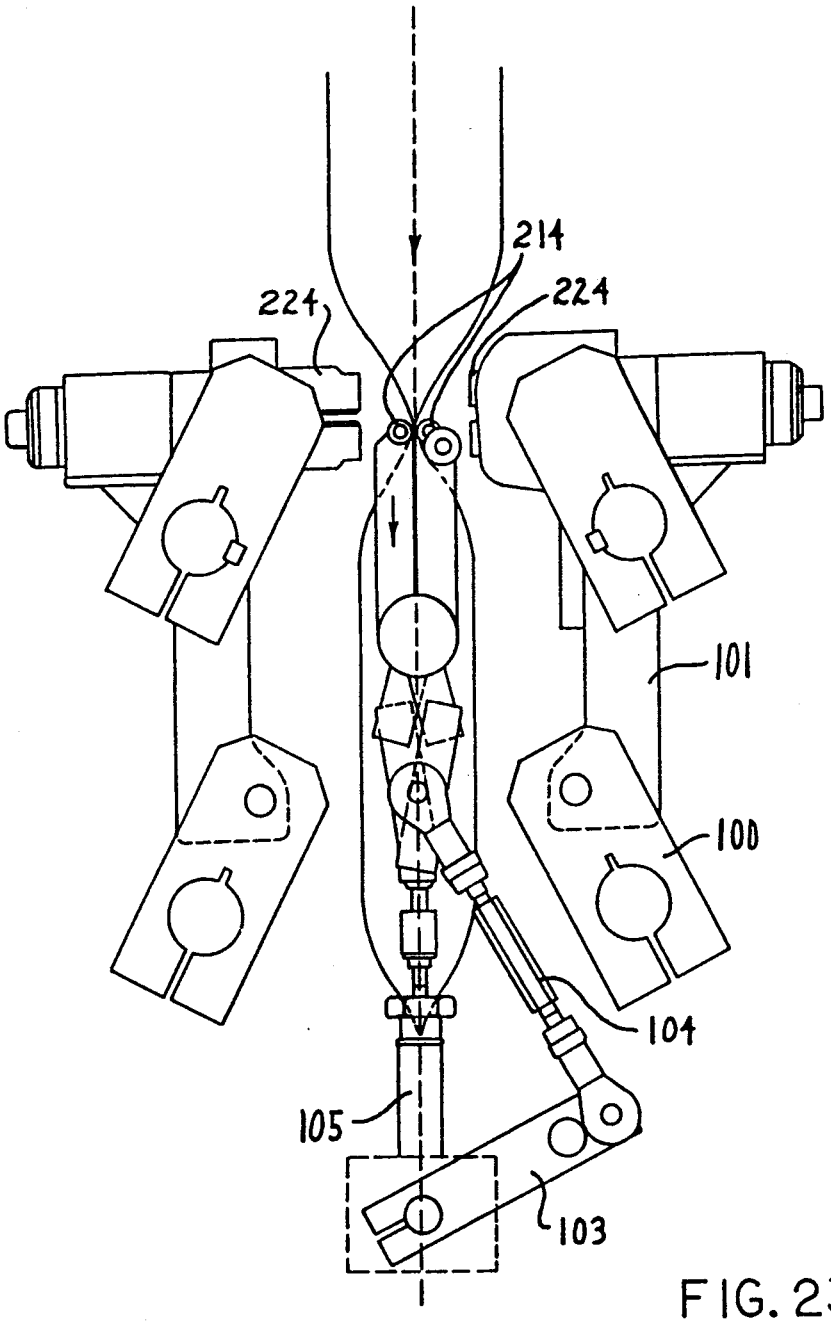
Figure 24:
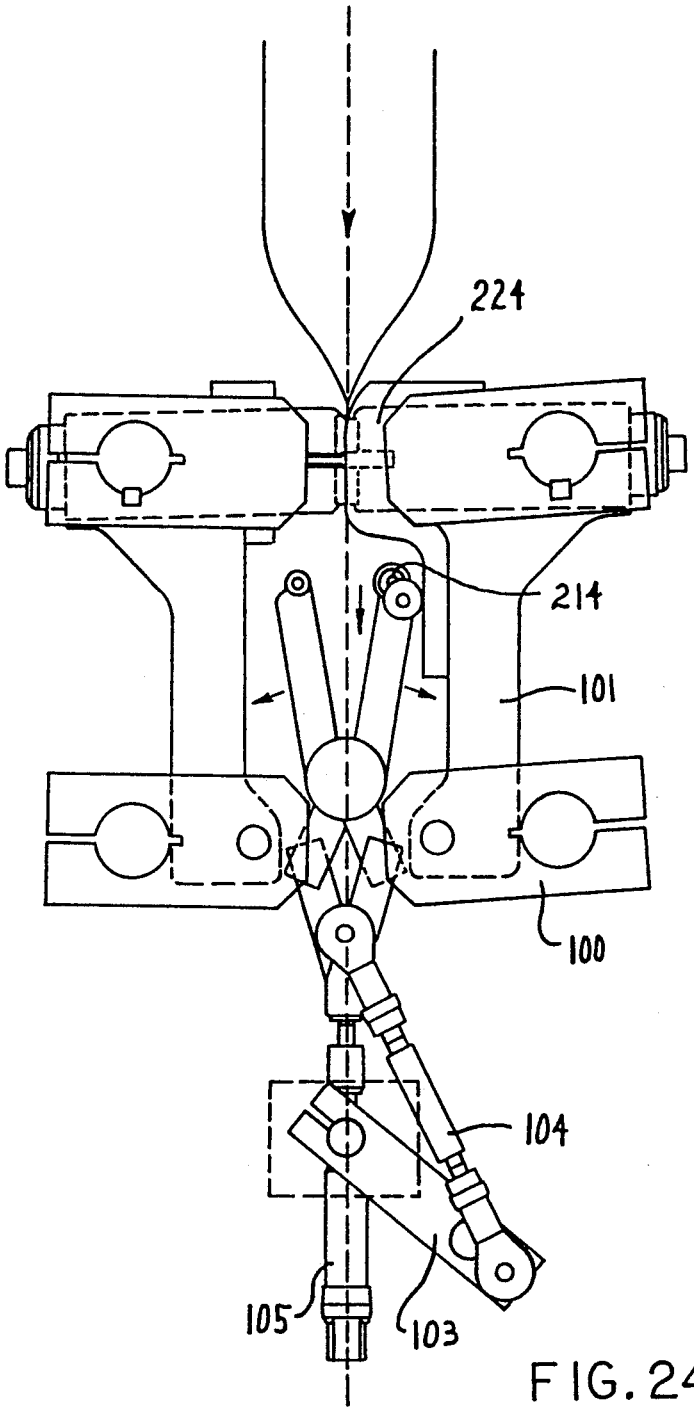

FIGS. 21 and 24 each show different operating sequences of the arrangement shown in FIG. 20. FIG. 21 shows an operation in which the stripper tools 214, with the cross-sealing jaw 224 being open, are moved upwardly and are in a state where the closing operation of the stripper tools 214 has started as illustrated by the arrows. FIG. 22 shows the stripper tools 214 in a closed state and in which the downwardly stripping movement begins. FIG. 23 shows an operating state in which the stripping operation has continued, while FIG. 24 shows the end of the operating cycle whereat the two cross-sealing jaws 224 are pressed against one another, while the stripper tools 214 have been move apart in order to release the foil bag. From the sequence of movement of FIGS. 21 to 24 results the back and forth swinging movement of the drive lever 103 and of the levers 100. Furthermore, it can be seen from the positions of the pull rod 105 that the end of the pull rod is guided in the area of the curved track 106 not illustrated in FIGS. 21 to 24.

The invention is not to be limited to the illustrated exemplary embodiments, rather many possibilities for changes and modifications which are within the scope of the invention exist for the man skilled in the art.

The embodiments of the invention in which an exclusive property or privilege is claimed are defined as follows:

1. A stripper mechanism for a tubular bag packaging machine, comprising means thereon for forming a foil strip into a tube, defining a path of movement for the tube and introducing product to be packaged into a central region of the tube, longitudinal sealing jaw means for sealing a longitudinally extending seam on the tube, cross-sealing jaw means for forming the tube into a bag by sequentially effecting first and second spaced seams extending cross-wise to a longitudinal axis of the path of movement for the tube, the product being entrapped between said first and second seams, a stripper means for urging the product toward said first cross-wise extending seam prior to a closing of said second cross-wise extending seam to free an area at which said second seam will be located of product, said stripper means including at least two stripper rods arranged on opposite sides of said path of movement for the tube said stripper means including drive means for effecting a movement of said at least two stripper rods simultaneously along an outer side of the tube parallel to the longitudinal axis of the path of movement for the tube as well as toward and away from each other, said stripper rods each being mounted adjacent one end of each of a pair of elongated support arms pivotally connected together by a common pivot axle located mid-length of each thereof to form a scissors linkage, said stripper rods being each oriented on one side of said pivot axle, said drive means including (1) a common closing means connected to each said support arm adjacent an end thereof located on an opposite side of said pivot axle from said support rods for effecting a relative movement of said support rods toward and away from each other and (2) a longitudinal drive means for effecting a movement of said support rods along the outer side of the tube parallel to the longitudinal axis of the path of movement for the tube.

2. The mechanism according to claim 1, wherein said closing means is a piston-cylinder unit.

3. The mechanism according to claim 1, wherein said closing means include a pair of plate members oriented on opposite sides of the path of movement for the tube and supported for movement toward and away from one another, a portion of each said support arm on said one side of said pivot axle being engaged by a respective one of said plate members for effecting the movement of said support rods toward and away from each other.

4. The mechanism according to claim 1, wherein said closing means include elastic elements for continually urging said stripper rods away from each other.

5. The mechanism according to claim 1, wherein said longitudinal drive means includes a support member supporting thereon said support arms and said closing means.

6. The mechanism according to claim 1, wherein said longitudinal drive means includes a crank assembly.

7. The mechanism according to claim 1, wherein said longitudinal drive means includes a piston-cylinder arrangement.

8. The mechanism according to claim 1, wherein said longitudinal drive means includes a cam-plate element.

9. The mechanism according to claim 1, wherein said longitudinal drive means includes a first mechanism for effecting a lifting movement when said support rods are moved away from one another and a second mechanism for effecting a downward stripping movement when said support rods are moved toward one another.

10. The mechanism according to claim 9, wherein said first and second mechanisms are each a piston-cylinder arrangement.

11. A stripper mechanism for a tubular bag packaging machine, comprising cross-welding jaw means supported for simultaneous movement toward and into engagement with a tube moving along a path of movement to form a sealed cross seam in the tube as well as a movement away and out of engagement with the tube, first drive means for driving said cross-welding jaw means, two stripper tools arranged on opposite sides of a path of movement of the tube, a second drive means for effecting a movement of said stripper tools toward and away from each other, a carriage supported for movement in a direction parallel to a longitudinal axis of the path of movement of the tube, said stripper tools being mounted on and movable with said carriage, a third drive means connected to said carriage for effecting a movement of said carriage and said stripper tools thereon along the path of movement of the tube, and a fourth drive means interconnecting said first and second drive means for providing a common drive source for said first and second drive means.

12. The stripper mechanism according to claim 11, wherein said third drive means includes a means for facilitating a changing of a distance travelled by said carriage.

13. The stripper mechanism according to claim 12, wherein said second drive means for said stripper tools includes safety plates.

14. The stripper mechanism according to claim 12, wherein a safety circuit is provided for the control of said second and third drive means for the stripper tools for the cross-welding jaws, which includes a sensor for checking the opening and closing operation.

15. The stripper mechanism according to claim 14, wherein the sensor is an inductive sensor which is associated with an operating element of the stripper tools.

16. The stripper mechanism according to claim 12, wherein said second drive means is a crank-drive mechanism having a crank arm and a crank link interconnecting said crank arm and said carriage, and wherein said means for facilitating a changing of the distance travelled by said carriage includes a means for changing a length of said crank link.

17. The stripper mechanism according to claim 11, wherein said second drive means includes a means for facilitating a change in timing of a closing and opening movement of the stripper tools and thereby a changing of a path of movement of said stripper tools.

18. The stripper mechanism according to claim 11, wherein said third drive means includes a crank arm and a drive rod interconnecting said crank arm and said carriage, an end of said drive rod connected to said carriage including a first pivot means for pivotally connecting said drive rod to said carriage, and wherein an other end of said drive rod connected to said crank arm includes a second pivot means for pivotally connecting said drive rod to said crank arm, said second pivot means including a guide bolt means and slide means on said crank arm for slidingly supporting said guide bolt means for movement with said crank arm and along a length of said crank arm, said guide bolt means being pivotally connected to said drive rod.

19. The stripper mechanism according to claim 18, wherein said third drive means further includes a cam-plate element oriented along side said crank arm and having a contoured surface means thereon, said guide bolt means including means engaging said contoured surface means so that as said crank arm rotates, said guide bolt means will slide on said slide means controlled by said contoured surface means.

20. The stripper mechanism according to claim 19, wherein an initial-tensioning means is provided for urging and keeping said guide rod means in engagement with said contoured surface means on said cam-plate element.

21. The stripper mechanism according to claim 20, wherein said cam plate element is fixedly oriented along side said crank arm, said contoured surface means encircling an axis of rotation of said crank arm.

22. The stripper mechanism according to claim 18, wherein said guide slide means is a slotted hole in said crank arm.

23. The stripper mechanism according to claim 19, wherein said contoured surface means is at least one of a circular contour and an ellipsoidal contour.

24. The stripper mechanism according to claim 26, wherein said cam plate element is exchangeably oriented along side said crank arm.

25. The stripper mechanism according to claim 11, wherein said second drive means is a pneumatic cylinder supported on said carriage.

* * * * *

UNITED STATES PATENT AND TRADEMARK OFFICE

CERTIFICATE OF CORRECTION

PATENT NO. : 5 203 145

DATED : April 20, 1993

INVENTOR(S) : Roman KAMMLER et al

It is certified that error appears in the above-identified patent and that said Letters Patent is hereby corrected as shown below:

Column 12, line 6; after "tube" insert ---,---.

Column 14, line 29; delete "guide".

line 34; change "26" to ---20---.

Signed and Sealed this

Eleventh Day of January, 1994

Bruce Lehman

*Attest:*

BRUCE LEHMAN

*Attesting Officer*

*Commissioner of Patents and Trademarks*